US010018929B2

(12) United States Patent
Kawasaki et al.

(10) Patent No.: US 10,018,929 B2
(45) Date of Patent: Jul. 10, 2018

(54) IMAGE FORMING APPARATUS AND IMAGE FORMING SYSTEM

(71) Applicant: Konica Minolta, Inc., Chiyoda-ku, Tokyo (JP)

(72) Inventors: Tomohiro Kawasaki, Sagamihara (JP); Hiroyuki Saito, Tokyo (JP); Kazuhiro Saito, Hino (JP); Kei Yuasa, Hachioji (JP)

(73) Assignee: Konica Minolta, Inc., Tokyo (JP)

( * ) Notice: Subject to any disclaimer, the term of this patent is extended or adjusted under 35 U.S.C. 154(b) by 0 days.

(21) Appl. No.: 15/338,906

(22) Filed: Oct. 31, 2016

(65) Prior Publication Data

US 2017/0153573 A1 Jun. 1, 2017

(30) Foreign Application Priority Data

Nov. 27, 2015 (JP) ..... 2015-231798

(51) Int. Cl.
*G03G 8/00* (2006.01)
*G03G 15/01* (2006.01)
(Continued)

(52) U.S. Cl.
CPC ..... *G03G 8/00* (2013.01); *G03G 15/0121* (2013.01); *G03G 15/0865* (2013.01); *G03G 15/6585* (2013.01)

(58) Field of Classification Search
CPC .... G03G 7/0006; G03G 8/00; G03G 15/0121; G03G 15/1625; G03G 15/6582;
(Continued)

(56) References Cited

U.S. PATENT DOCUMENTS 5,234,783 A * 8/1993 Ng ..... G03G 8/00 430/45.53
2005/0281184 A1* 12/2005 Sakata ..... B26D 5/00 369/275.3
(Continued)

FOREIGN PATENT DOCUMENTS

JP 2003-181991 7/2003
JP 2006-11218 A 1/2006
(Continued)

OTHER PUBLICATIONS

Extended European Search Report dated Apr. 18, 2017 for European Patent Application No. 16197010.8, 8 pages.
(Continued)

*Primary Examiner* — Benjamin Schmitt
(74) *Attorney, Agent, or Firm* — Squire Patton Boggs (US) LLP

(57) ABSTRACT

An image forming apparatus includes: a color toner supply unit configured to supply, to a recording medium, color toner for forming a toner image on the recording medium; a transparent toner supply unit configured to supply, to the recording medium, transparent toner having no releasability from a surface member bonded to a surface of the recording medium on which the toner image is formed; and a control unit configured to control the transparent toner supply unit to supply the transparent toner to cover the color toner supplied from the color toner supply unit to the recording medium.

10 Claims, 8 Drawing Sheets

(51) Int. Cl.
*G03G 15/08* (2006.01)
*G03G 15/00* (2006.01)

(58) Field of Classification Search
CPC ..... G03G 15/6585; G03G 2215/00801; G03G 2215/00805; G03G 2215/00814
USPC ..... 399/40, 53, 231, 341, 342; 430/123.57, 430/126.1
See application file for complete search history.

(56) References Cited

U.S. PATENT DOCUMENTS

| | | | | |
|---|---|---|---|---|
| 2009/0034998 | A1* | 2/2009 | Omata | G03G 15/657 399/45 |
| 2009/0044915 | A1* | 2/2009 | Mizutani | B32B 37/003 156/384 |
| 2011/0103811 | A1 | 5/2011 | Tamaki | |
| 2011/0123209 | A1* | 5/2011 | Akita | G03G 15/0131 399/49 |
| 2012/0237698 | A1 | 9/2012 | Funahashi et al. | |
| 2013/0164004 | A1 | 6/2013 | Ai | |

FOREIGN PATENT DOCUMENTS

| | | |
|---|---|---|
| JP | 2011-133866 | 7/2011 |
| JP | 2012-086461 | 5/2012 |
| JP | 2012-192706 | 10/2012 |
| JP | 2013-022754 | 2/2013 |

OTHER PUBLICATIONS

Notice of Reasons for Rejection dated Sep. 12, 2017, in Japanese Patent Application No. 2015-231798, 13 pages.
Notice of Reasons for Rejection dated Feb. 6, 2018, in Japanese Patent Application No. 2015-231798, 11 pages.

* cited by examiner

100

IMAGE FORMING APPARATUS AND IMAGE FORMING SYSTEM

The entire disclosure of Japanese Patent Application No. 2015-231798 filed on Nov. 27, 2015 including description, claims, drawings, and abstract are incorporated herein by reference in its entirety.

BACKGROUND OF THE INVENTION

Field of the Invention

The present invention relates to an image forming apparatus and an image forming system.

Description of the Related Art

Generally, an image forming apparatus (printer, copying machine, facsimile machine, or the like) using an electrophotographic process technology irradiates (exposes) a photoreceptor drum (image carrier) electrically charged with laser light based on image data to form an electrostatic latent image. Then, toner is supplied from a developing device to the photoreceptor drum on which an electrostatic latent image is formed to make the electrostatic latent image visible, and a toner image is formed. Furthermore, the toner image directly or indirectly transferred to paper is heated, pressed, and fused by a fuser nip, and the toner image is formed on the paper.

Image forming systems are put into practical use, each of the image forming systems including such an image forming apparatus as described above, and a lamination unit for subjecting label paper (recording medium) on which a toner image is formed by the image forming apparatus, to lamination (bonding). The label paper mainly includes three layers, that is, a surface layer, an adhesive layer, and a release layer, and after the toner image is formed on the surface layer, the label paper is pressed, heated, and then cut out together with a laminated portion (surface member) having an adhesive layer, in the following processes, and the label paper is used, as a laminated label sticker, to be applied to an objective merchandise product. Furthermore, the laminated label sticker is used for advertisements, industrial products, food products, drink products, medical products, or the like, and the label paper subjected to lamination is increased in durability, water resistance, visibility or the like of the label paper.

Furthermore, toner used for such an image forming apparatus includes wax or a mold release agent to secure separability from a member in a fusing unit, for example, a fixing belt. For example, in JP 2006-11218 A, a surface of a toner image formed on a sheet with color toners has a transparent toner layer containing the wax component.

However, during forming an image, the wax or the mold release agent may exude from the toner due to influence of heat in a fusing process. When the wax or mold release agent exudes from a toner image formed on the surface layer of the label paper, the toner image on the surface layer of the label paper is likely to be separated from the adhesive layer of the laminated portion, and an adhesive force is reduced between the surface layer of the label paper and the adhesive layer of the laminated portion.

Therefore, when the toner described in JP 2006-11218 A is applied to label paper to be subjected to lamination, the laminated portion is likely to be separated from the label paper upon cutting out a portion as a label sticker from the label paper.

SUMMARY OF THE INVENTION

An object of the present invention is to provide an image forming apparatus and an image forming system by which when a surface member is bonded to a surface of a recording medium, the surface member can be prevented from being separated from the recording medium.

To achieve the abovementioned object, according to an aspect, an image forming apparatus reflecting one aspect of the present invention comprises: a color toner supply unit configured to supply, to a recording medium, color toner for forming a toner image on the recording medium; a transparent toner supply unit configured to supply, to the recording medium, transparent toner having no releasability from a surface member bonded to a surface of the recording medium on which the toner image is formed; and a control unit configured to control the transparent toner supply unit to supply the transparent toner to cover the color toner supplied from the color toner supply unit to the recording medium.

To achieve the abovementioned object, according to an aspect, an image forming system reflecting one aspect of the present invention comprises: the image forming apparatus described above; and a bonding device configured to bond a surface member to the recording medium on which a toner image is formed.

BRIEF DESCRIPTION OF THE DRAWINGS

The above and other objects, advantages and features of the present invention will become more fully understood from the detailed description given hereinbelow and the appended drawings which are given by way of illustration only, and thus are not intended as a definition of the limits of the present invention, and wherein.

DESCRIPTION OF THE PREFERRED EMBODIMENTS

Figure 1:
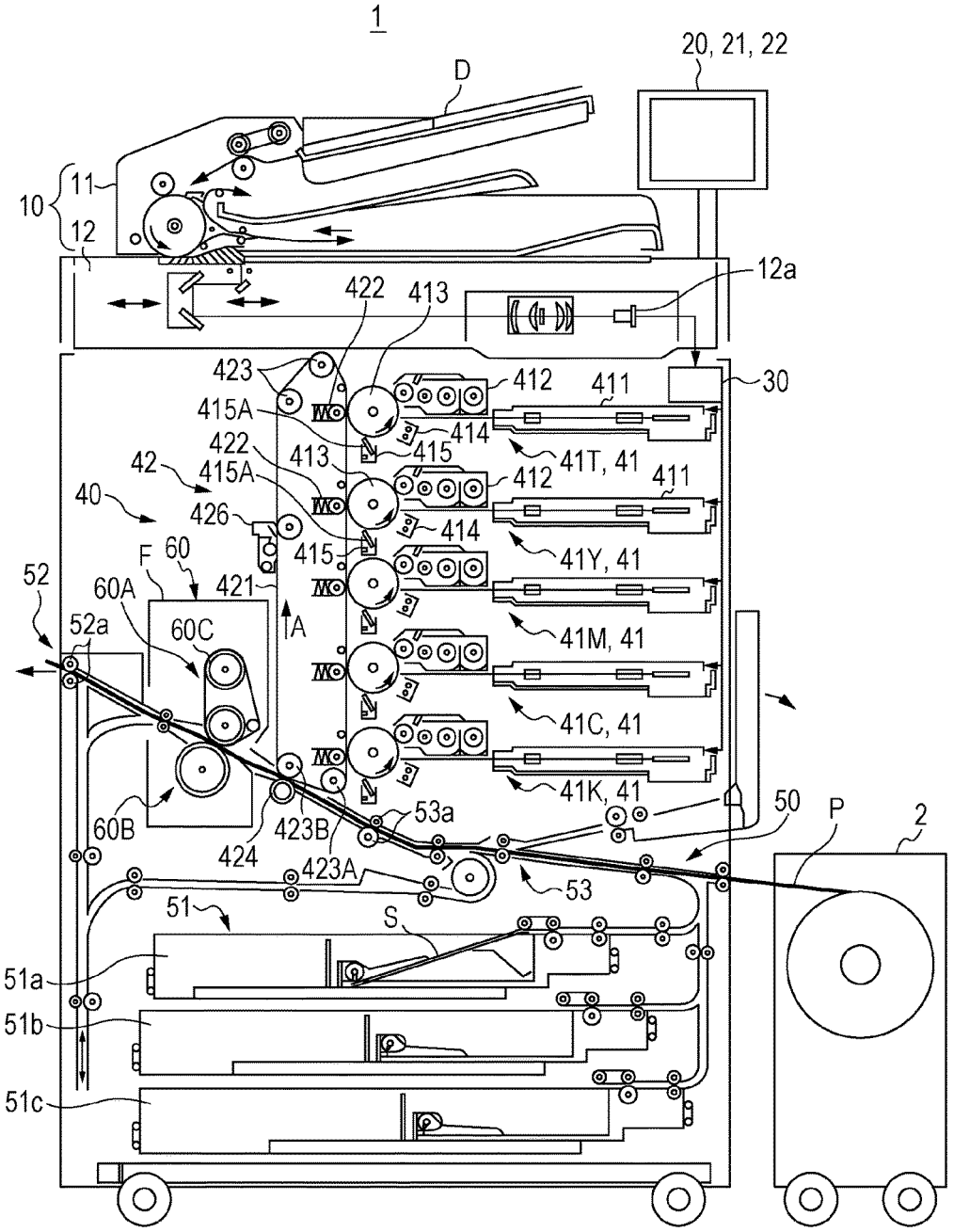
FIG. 1 is a schematic diagram illustrating an overall configuration of an image forming apparatus according to the present embodiment.
Figure 2:
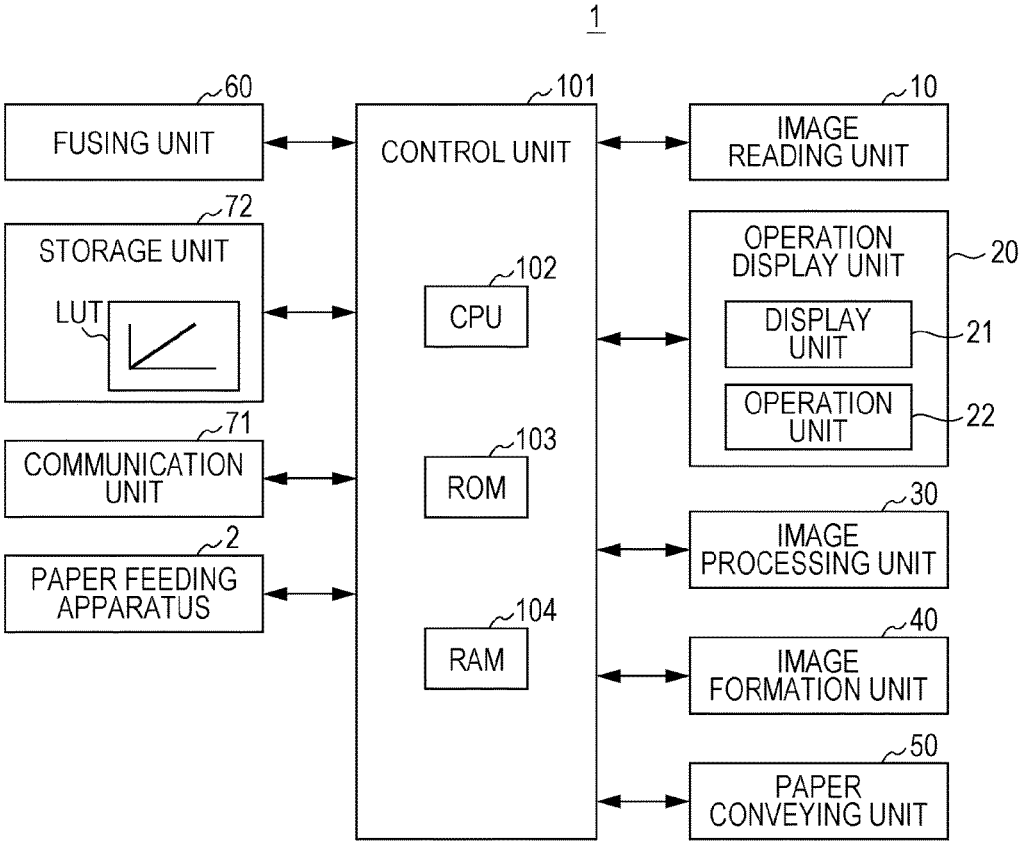
FIG. 2 is a diagram illustrating a main portion of a control system of the image forming apparatus according to the present embodiment.

Hereinafter, an embodiment of the present invention will be described in detail with reference to the drawings. However, the scope of the invention is not limited to the illustrated examples. FIG. 1 is a schematic diagram illustrating an overall configuration of an image forming apparatus 1 according to the present embodiment. FIG. 2 is a diagram illustrating a main portion of a control system of the image forming apparatus 1 according to the present embodiment.

The image forming apparatus 1 is an apparatus using label paper P or a sheet S (non-label paper), such as continuous paper or elongated paper represented by a thick line in FIG. 1, and forming an image on the label paper P or the sheet S. The label paper P includes three layers of a surface layer, an adhesive layer, and a release layer, and is for example fed from a paper feeding apparatus 2 constituted separately from the image forming apparatus 1, into the image forming apparatus 1. The label paper P corresponds to a "recording medium" according to the present invention.

The image forming apparatus 1 illustrated in FIGS. 1 and 2 is a color image forming apparatus employing an intermediate transfer process, using an electrophotographic process technology. That is, the image forming apparatus 1 primarily transfers a toner image of each of four colors of Y (yellow), M (magenta), C (cyan), K (black) formed on a photoreceptor drum 413, to an intermediate transfer belt 421, superposes color toner images of four colors on the intermediate transfer belt 421, and then secondarily transfers the four color toner images to the label paper P or the sheet S to form an image.

Furthermore, for the image forming apparatus 1, a tandem system is employed in which photoreceptor drums 413 corresponding to the four colors of YMCK are disposed in series, in a running direction of the intermediate transfer belt 421, and the toner images of respective colors are successively transferred to the intermediate transfer belt 421, in a single procedure.

As illustrated in FIG. 2, the image forming apparatus 1 includes an image reading unit 10, an operation display unit 20, an image processing unit 30, an image formation unit 40, a sheet conveying unit 50, a fusing unit 60, and a control unit 101.

The control unit 101 includes a central processing unit (CPU) 102, a read only memory (ROM) 103, a random access memory (RAM) 104, and the like. The CPU 102 reads a program from the ROM 103 according to a process content and loads the program into the RAM 104, and performs centralized control of blocks of the image forming apparatus 1, in cooperation with the loaded program. At this time, various data stored in a storage unit 72 are referred to. The storage unit 72 includes, for example, a non-volatile semiconductor memory (so-called flash memory) or a hard disk drive.

The control unit 101 transmits and receives various data, through a communication unit 71, with an external device (e.g., personal computer) connected to a communication network such as a local area network (LAN) or a wide area network (WAN). The control unit 101 receives for example image data transmitted from the external device, and forms an image on the label paper P or the sheet S, on the basis of the image data (input image data). The communication unit 71 includes for example a communication control card such as a LAN card.

As illustrated in FIG. 1, the image reading unit 10 includes an automatic document feeding device 11 called an auto document feeder (ADF), and a document image scanning device 12 (scanner), and the like.

The automatic document feeding device 11 conveys a document D put in a document tray with a conveyance mechanism, and delivers the document D to the document image scanning device 12. The automatic document feeding device 11 allows continuous collective reading of images (including images on both sides) of a large number of documents D put in the document tray.

The document image scanning device 12 optically scans a document conveyed from the automatic document feeding device 11 onto a contact glass plate, or a document put on the contact glass plate, focuses light reflected from the document on a light receiving surface of a charge coupled device (CCD) sensor 12*a*, and reads a document image. The image reading unit 10 generates input image data, on the basis of a read result by the document image scanning device 12. This input image data is subjected to predetermined image processing in the image processing unit 30.

As illustrated in FIG. 2, the operation display unit 20 includes, for example, a liquid crystal display (LCD) with a touch panel, and functions as a display unit 21 and an operation unit 22. The display unit 21 displays various operation screens, an image condition, an operation state of each function, or the like, according to a display control signal input from the control unit 101. The operation unit 22 includes various operation keys such as a numeric keypad, a start key, and the like, receives various operations input by a user, and outputs an operation signal to the control unit 101.

The image processing unit 30 includes a circuit or the like performing digital image processing on the input image data, according to default setting or user's setting. For example, the image processing unit 30 performs tone correction, on the basis of tone correction data (tone correction table), under control of the control unit 101. Furthermore, the image processing unit 30 performs, on the input image data, various correction processing such as color correction or shading correction, compression processing, or the like, in addition to the tone correction. The image formation unit 40 is controlled, on the basis of the image data subjected to the processing.

As illustrated in FIG. 1, the image formation unit 40 includes image forming units 41Y, 41M, 41C, and 41K, an intermediate transfer unit 42, and the like. The image forming units 41Y, 41M, 41C, and 41K form an image using color toners respectively having a Y component, an M component, a C component, and a K component, on the basis of the input image data.

The image forming units 41Y, 41M, 41C, and 41K for the Y component, M component, C component, K component have a similar configuration. For convenience of illustration and description, common elements are denoted by the same reference signs, and when the common elements are to be distinguished from each other for representation, a letter Y, M, C, or K is added to the reference signs. In FIG. 1, only elements of the image forming unit 41Y for the Y component are denoted by reference signs, and reference signs for the other image forming units 41M, 41C, and 41K are omitted.

The image forming unit 41 includes an exposure device 411, a developing device 412, the photoreceptor drum 413, a charging device 414, a drum cleaning device 415, and the like.

The photoreceptor drum 413 includes for example an organic photoreceptor. In the organic photoreceptor, a drum-shaped metal substrate has an outer peripheral surface on which a photosensitive layer is formed of a resin containing an organic photoconductor.

The control unit 101 controls drive current supplied to a drive motor (not illustrated) for rotating the photoreceptor drum 413 to rotate the photoreceptor drum 413 at a constant circumferential velocity.

The charging device 414 is for example a charger, and generates corona discharge to uniformly negatively charge a surface of the photoreceptor drum 413 having photoconductivity.

The exposure device 411 includes for example a semiconductor laser, and irradiates the photoreceptor drum 413 with laser light corresponding to an image having each color component. Therefore, in an image area on the surface of the photoreceptor drum 413, which is irradiated with the laser light, an electrostatic latent image having each color component is formed due to a potential difference between the image area and a background area.

The developing device 412 is a developing device having two-component reverse rotation, applies developer of each color component to the surface of the photoreceptor drum 413 to make the electrostatic latent image visible, and forms a toner image.

To the developing device 412, for example, a DC developing bias or a developing bias is applied. The DC developing bias has the same polarity as a charge polarity of the charging device 414, and the developing bias is obtained by superposing a DC voltage having the same polarity as the charge polarity of the charging device 414 to an AC voltage. Thus, reversal development for applying toner to the electrostatic latent image formed by the exposure device 411 is performed.

The drum cleaning device 415 has an elastic, flat drum cleaning blade 415A or the like brought into contact with the surface of the photoreceptor drum 413, and removes toner not transferred to the intermediate transfer belt 421 and remaining on the surface of the photoreceptor drum 413.

Furthermore, in the present embodiment, an image forming unit 41T is provided for transparent toner. The image forming unit 41T has a configuration similar to those of the other image forming units 41 for color toners, and is disposed at a position where transparent toner can be supplied on a color toner layer.

Furthermore, the color toners stored in the image forming units 41Y, 41M, 41C, and 41K contain wax and a mold release agent, but the transparent toner stored in the image forming unit 41T does not contain wax nor mold release agent. Note that, the image formation unit 40 including the image forming units 41Y, 41M, 41C, 41K, and 41T corresponds to a "color toner supply unit" and a "transparent toner supply unit" according to the present invention.

The transparent toner can be developed, and includes a resin such as a styrene-acrylic copolymer obtained by copolymerization of, for example, a styrenic monomer, an acrylate monomer, and a methacrylate monomer containing no coloring agent. As the transparent toner, for example, a thermoplastic or thermosetting resin such as a polyester resin may be used.

The intermediate transfer unit 42 includes the intermediate transfer belt 421, a primary transfer roller 422, a plurality of support rollers 423, a secondary transfer roller 424, a belt cleaning device 426, and the like. The intermediate transfer belt 421 corresponds to an "image carrier" according to the present invention.

The intermediate transfer unit 42 includes an endless belt, and is stretched on the plurality of support rollers 423 into a loop shape. At least one of the plurality of support rollers 423 includes a driving roller, and the other rollers include a driven roller. For example, a roller 423A disposed downstream from the primary transfer roller 422 for K component, in a belt running direction is preferably a driving roller. Thus, the belt can have a constant running speed at a primary transfer nip. Rotation of the driving roller 423A causes the intermediate transfer belt 421 to run at a constant speed in a direction indicated by an arrow A.

The intermediate transfer belt 421 is an electrically conductive and elastic belt, and has a surface provided with a high resistance layer having a volume resistivity of 8 to 11 [log Ω·cm]. The intermediate transfer belt 421 is rotatably driven by a control signal from the control unit 101. Note that, as long as the intermediate transfer belt 421 has electrical conductivity and elasticity, the intermediate transfer belt 421 is not limited in material, thickness, and hardness, The primary transfer roller 422 is disposed on an inner peripheral side of the intermediate transfer belt 421 to be opposite to the photoreceptor drum 413 for each color component. The primary transfer roller 422 is brought into pressure-contact with the photoreceptor drum 413, with the intermediate transfer belt 421 therebetween, and the primary transfer nip is formed to transfer a toner image from the photoreceptor drum 413 to the intermediate transfer belt 421.

The secondary transfer roller 424 is disposed on an outer peripheral side of the intermediate transfer belt 421 to be opposite to the backup roller 423B disposed downstream from the driving roller 423A in a belt running direction. The secondary transfer roller 424 is brought into pressure-contact with the backup roller 423B, with the intermediate transfer belt 421 therebetween, and secondary transfer nip is formed to transfer a toner image from the intermediate transfer belt 421 to the label paper P or the sheet S.

When the intermediate transfer belt 421 passes through the primary transfer nip, toner images on the photoreceptor drums 413 are primarily transferred sequentially on the intermediate transfer belt 421. Specifically, primary transfer bias is applied to the primary transfer roller 422 to apply electrical charge having polarity opposite to that of the toner on a back side of the intermediate transfer belt 421, that is, a side making contact with the primary transfer roller 422, and each of the toner images is electrostatically transferred to the intermediate transfer belt 421.

Then, when the label paper P or the sheet S passes through the secondary transfer nip, the toner images on the intermediate transfer belt 421 are secondarily transferred to the label paper P or the sheet S. Specifically, a secondary transfer bias is applied to the backup roller 423B, to apply electrical charge having the same polarity as that of the toner, to a surface side of the label paper P or the sheet S, that is, to a side making contact with the intermediate transfer belt 421, the toner image is electrostatically transferred to the label paper P or the sheet S, and the label paper P or the sheet S is conveyed toward the fusing unit 60.

The belt cleaning device 426 removes untransferred toner remaining on the surface of the intermediate transfer belt 421, after secondary transfer. Note that, instead of the secondary transfer roller 424, a configuration, so-called secondary transfer belt, may be employed in which a secondary transfer belt is stretched on a plurality of support rollers including a secondary transfer roller.

The fusing unit 60 includes an upper fusing unit 60A having a toner-fixed-surface side member disposed on a toner-fixed surface of the label paper P or the sheet S, that is on a surface side on which a toner image is formed, a lower fusing unit 60B having a back side support member disposed on a back side of the label paper P or the sheet S, that is, on a back side of the toner-fixed surface, a heat source 60C, and the like. The back side support member is brought into pressure-contact with the toner-fixed-surface side member to form fuser nip for holding and conveying the label paper P or the sheet S.

The fusing unit 60 heats and presses, at the fuser nip, the conveyed label paper P or sheet S on which the toner image is secondarily transferred to fuse the toner image on the label paper P or the sheet S. The fusing unit 60 is disposed as a unit in a fuser F. Furthermore, in the fuser F, an air separation unit may be disposed which blows air to separate the label paper P or sheet S from the toner-fixed-surface side member or back side support member.

The sheet conveying unit 50 includes a paper feed unit 51, a paper delivery unit 52, a conveyance path 53, and the like. The paper feed unit 51 includes three paper feed tray units 51*a* to 51*c* in which sheets S (standard paper, special paper) identified on the basis of a basis weight, size, or the like are stored according to a predetermined kind. The conveyance path 53 has a plurality of conveyance rollers such as a registration roller pair 53*a*.

The sheets S stored in the paper feed tray units 51*a* to 51*c* are delivered one by one from an uppermost portion, and conveyed to the image formation unit 40 through the conveyance path 53. At this time, a registration roller portion, in which the registration roller pair 53*a* is disposed, corrects inclination of the fed sheet S, and adjusts conveyance timing. Then, in the image formation unit 40, the toner images on the intermediate transfer belt 421 are secondarily transferred to one side of the sheet S collectively, and then subjected to a fusing process in the fusing unit 60.

Furthermore, the label paper P fed from the paper feeding apparatus 2 to the image forming apparatus 1 is conveyed to the image formation unit 40 through the conveyance path 53. Then, in the image formation unit 40, the toner images on the intermediate transfer belt 421 are secondarily transferred to one side of the label paper P collectively, and then subjected to the fusing process in the fusing unit 60. The sheet S or label paper P on which an image is formed is delivered outside the apparatus, from the paper delivery unit 52 including paper delivery rollers 52*a*.

Figure 3:
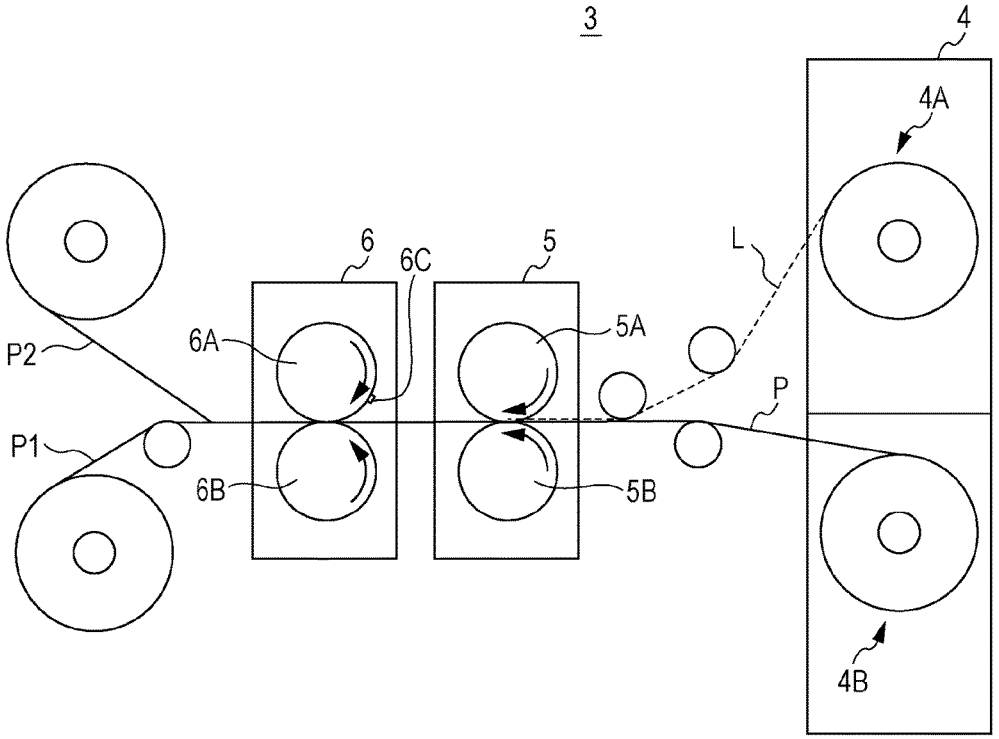
FIG. 3 is a schematic diagram illustrating an overall configuration of a laminating apparatus according to the present embodiment.
Figure 4:
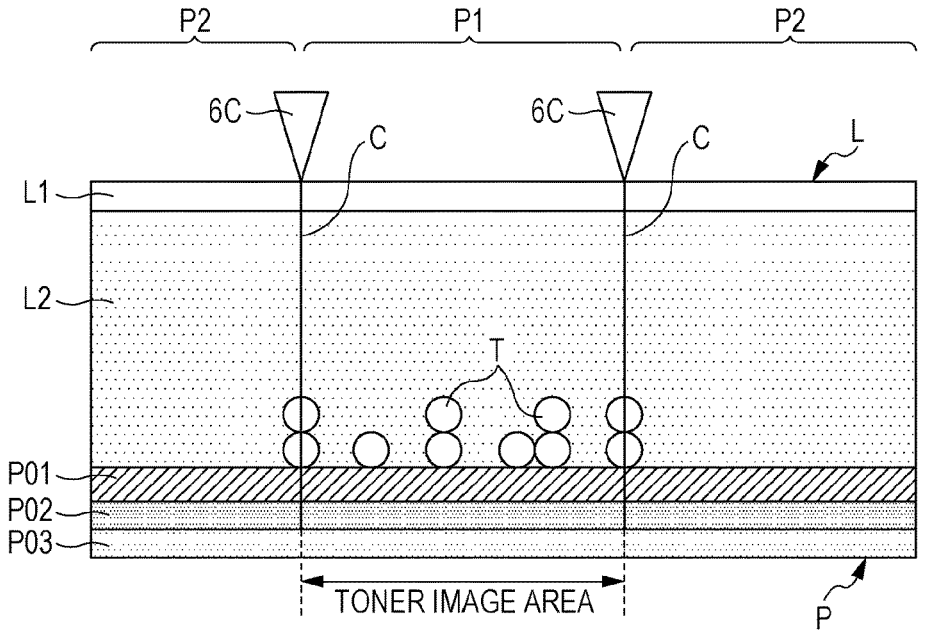
FIG. 4 is a cross-sectional view of label paper on which a laminated portion is formed.

The label paper P delivered outside from the apparatus is wound into a roll shape for example by a take-up roller, and then stored in a laminating apparatus 3 when the label paper P is laminated. FIG. 3 is a schematic diagram illustrating an overall configuration of the laminating apparatus 3 according to the present embodiment. FIG. 4 is a cross-sectional view of the label paper P on which a laminated portion L is formed.

As illustrated in FIG. 3, the laminating apparatus 3 includes a lamination conveyor 4, a lamination unit 5, and a die-cutting unit 6. The lamination unit 5 corresponds to a "bonding device" according to the present invention, and the die-cutting unit 6 corresponds to a "cutting device" according to the present invention.

The lamination conveyor 4 stores a first roll portion 4A having the laminated portion L wound into a roll shape, and a second roll portion 4B having the label paper P on which a toner image is formed, wound into a roll shape, and conveys the laminated portion L and the label paper P to the lamination unit 5. Note that, the second roll portion 4B is placed in the lamination conveyor 4 by the user.

As illustrated in FIG. 4, the laminated portion L is a transparent film sheet stuck to the label paper P by being heat-treated, and has a surface layer L1 and an adhesive layer L2. The surface layer L1 is made of a material such as polyester, polyethylene, and polypropylene. The laminated portion L corresponds to a "surface member" according to the present invention.

The label paper P has the surface layer P01 on which a toner image is formed, the adhesive layer P02, and the release layer P03. The surface layer P01 and the release layer P03 are bonded through the adhesive layer P02, and on the surface layer P01, the adhesive layer L2 of the laminated portion L is placed.

As illustrated in FIG. 3, the laminated portion L and the label paper P are conveyed by conveyance rollers or the like without reference signs, and conveyed to the lamination unit 5 while the laminated portion L is superposed on a surface side of the label paper P on which a toner image is formed.

The lamination unit 5 includes a heat roller 5A and a pressure roller 5B. The lamination unit 5 passes the laminated portion L and the label paper P through a nip position between the heat roller 5A and the pressure roller 5B to fuse the laminated portion L on the label paper P for lamination.

The die-cutting unit 6 includes a die cutting roller 6A and an opposing roller 6B. The die cutting roller 6A has a surface on which a die-cutting blade 6C is provided for cutting out the laminated portion L and the label paper P into a shape of a sticker having a circular shape, square shape, or the like. The die-cutting blade 6C includes a plurality of blades circumferentially or axially arranged on the die cutting roller 6A. Note that, in FIG. 3, only one die-cutting blade 6C circumferentially positioned on the die cutting roller 6A is illustrated as a matter of convenience.

Rotation of the die cutting roller 6A and the opposing roller 6B moves the die-cutting blade 6C to a nip position between the die cutting roller 6A and the opposing roller 6B, and the laminated portion L and the label paper P are cut out.

Figure 5:
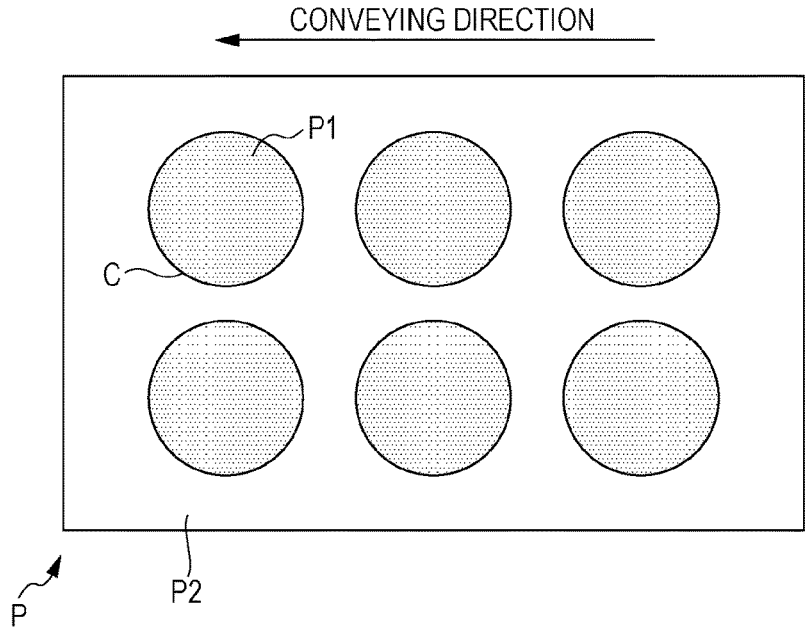
FIG. 5 is a diagram illustrating a cut-out label paper.

For example, when the die-cutting blade 6C has a circular shape, the label paper P is separated into a first portion P1 being a toner image area in a circular cut line C, and a second portion P2 being the other portion, as illustrated in FIG. 5.

As illustrated in FIG. 4, the die-cutting blade 6C cuts out a portion up to the release layer P03, that is, cuts out the laminated portion L, the surface layer P01 of the label paper P, and the adhesive layer P02 of the label paper P.

As illustrated in FIGS. 3 and 4, the label paper P passing through the die-cutting unit 6 is wound by a take-up roller not illustrated. More specifically, after the label paper P passes through the die-cutting unit 6, the second portion P2 is separated from the release layer P03, and then the first portion P1 sticking to the release layer P03 of the label paper P, and the second portion P2 separated from the release layer P03 are wound separately.

That is, separation of the release layer P03 from the adhesive layer P02 of the label paper P allows separation of the first portion P1 from the second portion P2, while leaving the first portion P1 being a portion serving as the label sticker on the release layer P03, and only the first portions P1 on the label paper P can be collected. Then, a portion other than the release layer P03 is inspected in the first portion P1, and only acceptable first portion can be applied to a merchandise product or the like.

Incidentally, toner T applied to the label paper P contains wax or a mold release agent to secure separability from the fixing belt being a member in the fusing unit 60. Such wax or mold release agent contained in the toner T in an uppermost layer of the label paper P may exude from the label paper P due to influence of heat in the fusing process.

When the wax or the mold release agent exudes from the label paper P, the adhesive layer L2 of the laminated portion L is likely to slip relative to the surface layer P01 of the label paper P, due to influence of the wax or the mold release agent, and an adhesive force is reduced between the adhesive layer L2 of the laminated portion L and the surface layer P01 of the label paper P. Therefore, upon inspection of the portion serving as the label sticker, the laminated portion L is likely to be separated from the surface layer P01 of the label paper P, at a portion of the cut line C.

Figure 6:
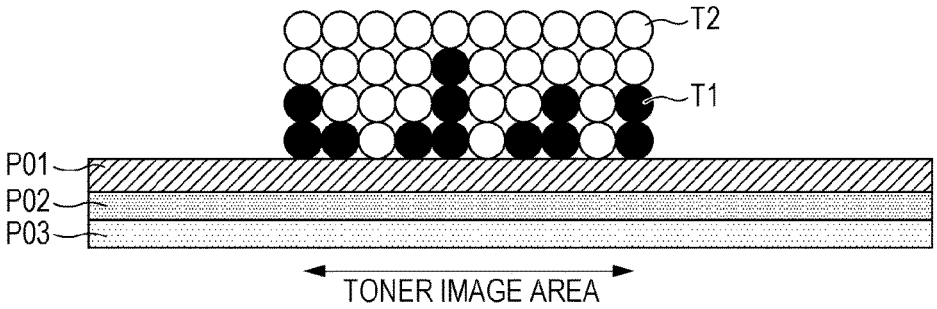
FIG. 6 is a cross-sectional view of label paper on which a toner image is formed, the toner image having arrangement of transparent toner.

Therefore, in the present embodiment, as illustrated in FIG. 6, the control unit 101 controls the image formation unit 40 to supply transparent toner T2 to cover color toner T1 supplied from the image formation unit 40 to the label paper P. Specifically, the control unit 101 controls the image formation unit 40 to supply the transparent toner T2 so that the transparent toner T2 is positioned in the uppermost layer at each position in the toner image area including the color toner T1 on the label paper P. Note that, FIGS. 6 to 11 are cross-sectional views each taken along a line passing through the center of the first portion P1 in FIG. 5, and the laminated portion L is omitted in the drawings for ease of viewing.

The transparent toner T2 does not contain the wax, mold release agent, or the like, and does not have releasability from the laminated portion L. Therefore, in the present embodiment, it is prevented that heat in the fusing process causes exudation of the wax or mold release agent from the toner image area, and the exuded wax or mold release agent causes slippage of the adhesive layer L2 of the laminated portion L relative to the surface layer P01 of the label paper P. Thus, the adhesive force between the adhesive layer L2 of the laminated portion L and the surface layer P01 of the label paper P is maintained, so that separation of the laminated portion L from the surface layer P01 of the label paper P can be prevented, upon inspection of the portion serving as the label sticker.

The control unit 101 controls an amount of the transparent toner T2 to be supplied to have a uniform thickness of the toner image including the color toner T1 and the transparent toner T2. Thus, partial level difference is prevented from being generated in the toner image during lamination.

Figure 7:
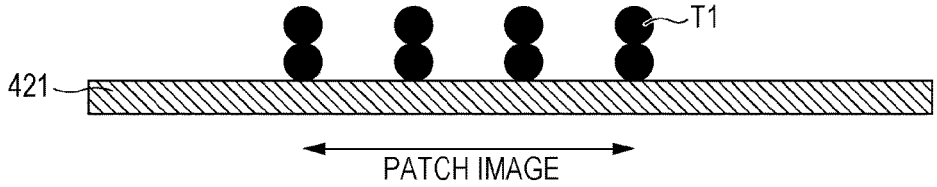
FIG. 7 is a cross-sectional view of an intermediate transfer belt on which a patch image is formed.

As illustrated in FIG. 7, for example, when a patch image for correcting uneven density of the toner image is formed on the intermediate transfer belt 421, the control unit 101 controls the image formation unit 40 not to supply the transparent toner T2 to the intermediate transfer belt 421. Since the patch image is not positioned on the label paper P, the color toner T1 is not covered by the transparent toner T2 in such a patch image, and the transparent toner T2 is prevented from being wasted.

Furthermore, commonly, toner contains the wax or the mold release agent to secure separability in the fusing unit 60, but the transparent toner does not have releasability, and is likely to be offset in the fusing unit 60. However, the transparent toner is not visually recognized by the user, and the label paper P is subjected to the lamination process, so that offset of the transparent toner from the label paper P does not bring about, for example, a noticeable disadvantage sufficient to determine generation of level difference in glossiness.

Furthermore, the fusing unit 60 is provided with a conventionally known cleaning member, such as a web roller, and the transparent toner offset on the fixing belt in the fusing unit 60 can be removed. In addition, even if the transparent toner is offset in the fusing unit 60, the transparent toner is transferred to the label paper P at any time, and the transparent toner can be removed from the fusing unit 60. The transparent toner transferred to the label paper P is subjected to the lamination process, and is not obviously determined to cause the level difference in glossiness. From the above description, even if there is an adverse effect of the transparent toner not containing the wax or mold release agent, quality of the toner image is not affected.

Note that, in the above embodiment, the transparent toner T2 is supplied to all positions in the toner image area, but the present invention is not limited to this configuration, and the transparent toner T2 may be not supplied to all positions.

Figure 8:
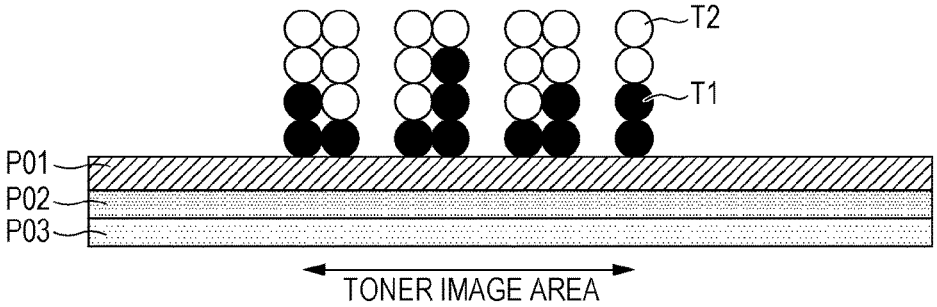
FIG. 8 is a cross-sectional view of label paper on which a toner image is formed according to a first arrangement example of transparent toner.

For example, as illustrated in FIG. 8, the control unit 101 may control the image formation unit 40 to supply the transparent toner T2 only to a portion in the toner image area to which the color toner T1 is supplied. Thus, the amount of the transparent toner T2 to be supplied can be reduced compared with that of FIG. 6.

Figure 9:
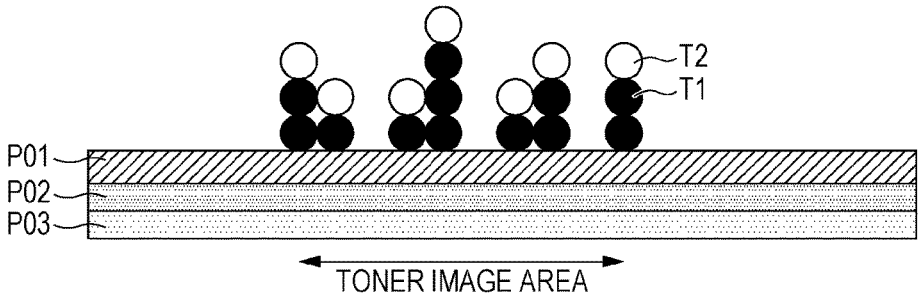
FIG. 9 is a cross-sectional view of label paper on which a toner image is formed according to a second arrangement example of transparent toner.

Furthermore, as illustrated in FIG. 9, the control unit 101 may control the image formation unit 40 to have the same thickness of the transparent toner T2 at positions to which the color toner T1 is supplied. FIG. 9 illustrates an example of the transparent toner T2 arranged one by one at positions to which the color toner T1 is supplied. Thus, the amount of the transparent toner T2 to be supplied can be further reduced compared with that of FIG. 8.

Figure 10:
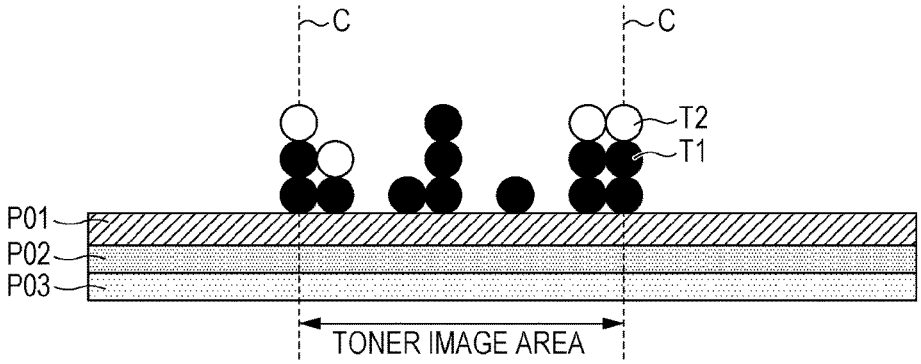
FIG. 10 is a cross-sectional view of label paper on which a toner image is formed according to a third arrangement example of transparent toner.

Furthermore, in the above embodiment, the transparent toner T2 is arranged on the color toner T1 in the toner image area, but the present invention is not limited to this configuration, and the transparent toner T2 may be supplied to the portion of the cut line C in the label paper P, that is, only at an end portion of a portion to be cut out, as illustrated in FIG. 10. Since the portion of the cut line C in the label paper P is positioned at an edge portion of the label sticker, when adhesiveness is secured at the portion, the laminated portion is not likely to be separated from the label paper P without bonding the other portion.

Therefore, when the transparent toner T2 is arranged only at the portion, the transparent toner T2 is particularly arranged only at a necessary portion, while preventing separation of the laminated portion L from the label paper P, and thus the amount of the transparent toner T2 to be supplied can be reduced.

Furthermore, in FIG. 10, the transparent toner T2 is arranged at a portion of the cut line C, that is, only at a portion within a predetermined range (e.g., 2 mm), on the inside of the edge of the portion to be cut out. Accordingly, even if cutting by the die-cutting blade is displaced inward from the cut line C, arrangement of the transparent toner T2 prevents exudation of the wax or mold release agent from the portion of the cut line C.

Note that, an arrangement example in FIG. 10 exemplifies that the transparent toner T2 is positioned on the cut line C, and each of the transparent toner T2 is partially positioned outside the cut line C, but an outside end of the transparent toner T2 may be positioned on the cut line C.

Figure 11:
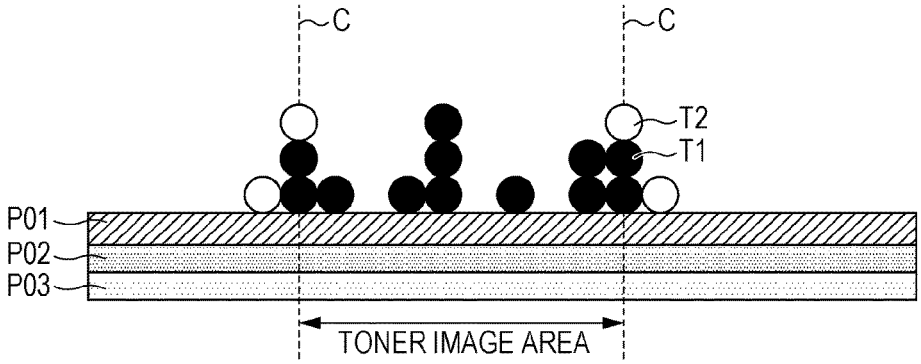
FIG. 11 is a cross-sectional view of label paper on which a toner image is formed according to a fourth arrangement example of transparent toner.

Furthermore, as illustrated in FIG. 11, the transparent toner T2 may be arranged only at a portion within a predetermined range (e.g., 2 mm), on the outside of the cut line C. Accordingly, even if cutting by the die-cutting blade is displaced outward from the cut line C, arrangement of the transparent toner T2 prevents exudation of the wax or mold release agent from the portion of the cut line C.

Note that, an arrangement example in FIG. 11 exemplifies that the transparent toner T2 is positioned on the cut line C, and each of the transparent toner T2 is partially positioned inside the cut line C, but an inside end of the transparent toner T2 may be positioned on the cut line C.

Figure 12A:
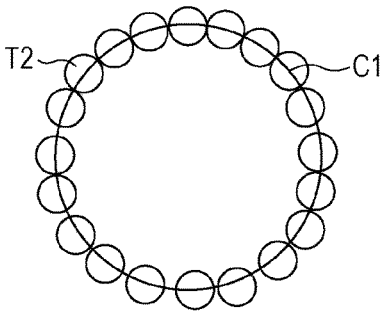
FIGS. 12A and 12B are diagrams illustrating arrangement examples of transparent toner along a circular cut line.
Figure 12B:
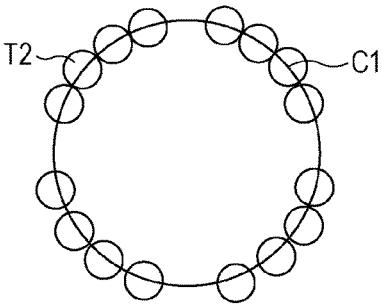
Figure 13A:
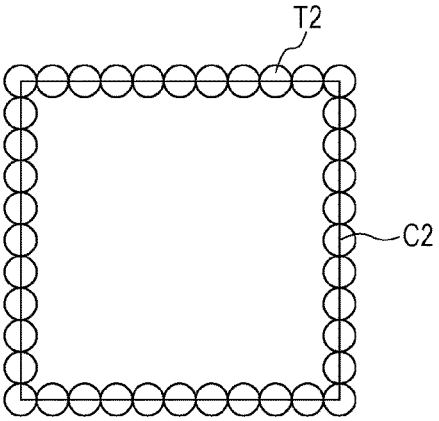
FIGS. 13A and 13B are diagrams illustrating arrangement examples of transparent toner along a square cut line.

Furthermore, in the portion to be cut out, the transparent toner may be supplied after being reduced in amount at a predetermined rate FIG. 12A is a diagram illustrating an example of the transparent toner T2 arranged along a circular cut line C1 without reducing the amount thereof, and FIG. 12B is a diagram illustrating an example of the transparent toner T2 arranged along the circular cut line C1, in which the amount of the transparent toner T2 is reduced at a rate of 80%. FIG. 13A is a diagram illustrating an example of the transparent toner T2 arranged along a square cut line C2 without reducing the amount thereof, and FIG. 13B is a diagram illustrating an example of the transparent toner T2 arranged along the square cut line C2, in which the amount of the transparent toner T2 is reduced at a rate of 80%.

Figure 13B:
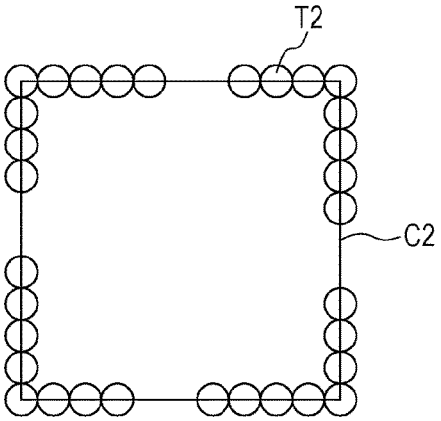

As illustrated in FIGS. 12A and 13A, when the transparent toner T2 is arranged fully along the cut lines C1 and C2, the amount of the transparent toner T2 to be supplied can be sufficiently reduced, but as illustrated in FIGS. 12B and 13B, even if the amount of the transparent toner T2 is reduced at a predetermined rate (80% relative to full arrangement), as long as the transparent toner T2 is arranged collectively within a range, adhesiveness can be maintained to some extent. Therefore, the reduction at a predetermined rate in the amount of the transparent toner T2 to be supplied can further reduce the amount of the transparent toner T2 to be supplied.

Figure 14:
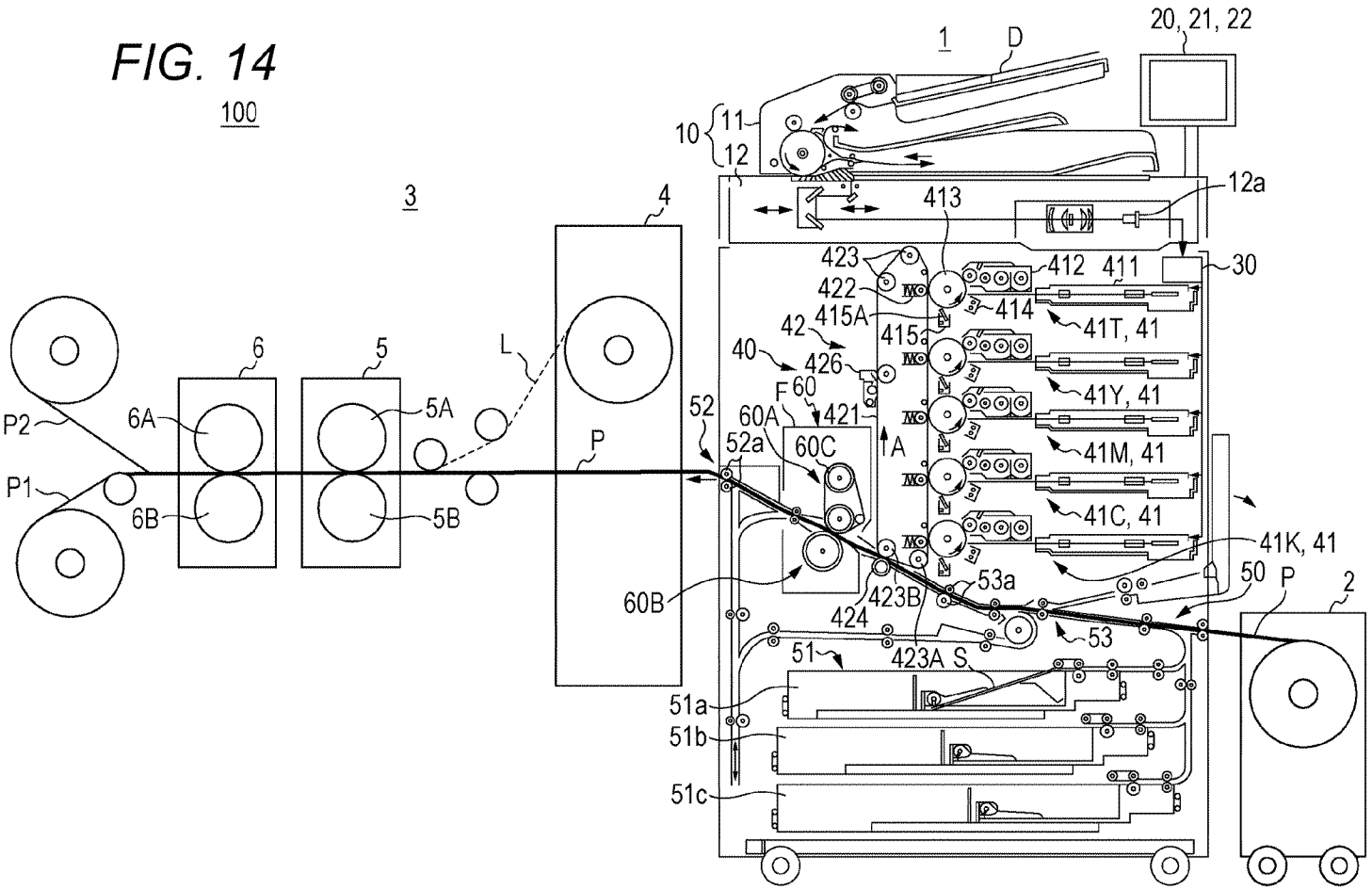
FIG. 14 is a schematic diagram illustrating an overall configuration of an image forming system including the image forming apparatus and the laminating apparatus according to the present embodiment.

Furthermore, the above embodiment can be applied to an image forming system 100 having the image forming apparatus 1 and the laminating apparatus 3. FIG. 14 is a schematic diagram illustrating an overall configuration of the image forming system 100 including the image forming apparatus 1 and the laminating apparatus 3 according to the present embodiment.

As illustrated in FIG. 14, the image forming system 100 includes the image forming apparatus 1 and the paper feeding apparatus 2 of FIG. 1, and the laminating apparatus 3 of FIG. 3. The lamination conveyor 4 of the laminating apparatus 3 is not provided with the second roll portion 4B, and the label paper P delivered from the paper delivery unit 52 is directly conveyed toward the lamination unit 5, through the lamination conveyor 4.

In such a configuration, separation of the lamination can be prevented due to the transparent toner, as in the above embodiment. Furthermore, in this image forming system 100, the laminating apparatus 3 has the die-cutting unit 6, but, for example, when only the lamination process is required, the die-cutting unit 6 may be eliminated.

Furthermore, in the above embodiment, the laminated portion L obtained by subjecting the label paper to the lamination process is exemplified as the surface member, but the present invention is not limited to this configuration. For example, the surface member may employ foil such as gold leaf stamped on the sheet. Furthermore, in this case, for example, a foil stamping device is used as the bonding device.

Since the foil stamped on the sheet is arranged on a toner image formed on the surface of the sheet, when the wax or mold release agent in the toner exudes, separation of the foil is generated as in the case of the lamination. The separation of the foil can be prevented by the image forming apparatus 1.

Furthermore, in the above embodiment, the die-cutting unit 6 is exemplified as the cutting device, but the present invention is not limited to this configuration, and, for example, a device configured to cut out the label paper by laser may be used.

In addition, any of the above embodiments is only by way of one specific example to implement the present invention, and is not to be construed as limiting the technical scope of the present invention thereto. In other words, the present invention can be implemented in various forms without departing from the spirit or the main characteristics of the present invention.

Lastly, an evaluation experiment in the image forming apparatus 1 according to the present embodiment will be described.

In this experiment, it was confirmed whether separation of the lamination is generated, when subjecting the label paper P on which a toner image is formed to lamination processing, using the image forming apparatus 1 illustrated in FIG. 1, and the laminating apparatus 3 illustrated in FIG. 3. Specifically, after the label paper P was cut out in a circular shape in lamination processing, as illustrated in FIG. 5, a specified adhesive tape was applied on the label paper P, and then, it was confirmed whether separation of the lamination was generated upon removing the adhesive tape.

For the developing device, a developing device having the two-component reverse rotation was used, toner having a particle diameter of 6 μm was used, a photoreceptor drum having an outer diameter of 60 mm was used, and processing speed was set to 315 mm/sec.

Furthermore, for the intermediate transfer belt, a belt of polyimide was used, and for the belt cleaning device, an urethane rubber blade having a thickness t=2 mm, a contact force of 20N, and a contact angle of 15° was used. For the secondary transfer roller, an urethane foam roller having an outer diameter of 25 mm was used, and for the backup roller, an aluminum roller having an outer diameter of 30 mm was used.

Furthermore, in the upper fusing unit, for the fixing belt, a belt having a substrate made of polyimide, an elastic layer made of silicone, and a surface layer made of tetrafluoroethylene was used, and for the heat roller of the upper fusing unit, a roller having a surface layer made of polytetrafluoroethylene, and having an outer diameter of 52 mm was used. Still further, an upper pressure roller having an outer diameter of 60 mm was used, and a lower pressure roller having a surface layer made of tetrafluoroethylene, and an outer diameter of 60 mm was used.

Conditions of each example are given in Table 1 and Table 2. Specifically, Table 1 indicates a toner image formation condition in each example, and Table 2 indicates a transparent toner supply condition in each example. Furthermore, in a comparative example, the transparent toner is not supplied to the toner image area.

TABLE 1

| | | Toner image formation condition | |
|---|---|---|---|
| | Image pattern | Color toner formation condition | Transparent toner formation condition |
| Comparative Example | YMCK mixture | Whole surface of toner image area | No supply of transparent toner |

TABLE 1-continued

| | Image pattern | Toner image formation condition: Color toner formation condition | Toner image formation condition: Transparent toner formation condition |
|---|---|---|---|
| Example 1 | YMCK mixture | Whole surface of toner image area | Supplied on whole surface of toner image area (FIG. 6) |
| Example 2 | YMCK mixture | 80% of whole toner image area | Supplied on whole surface of toner image area (FIG. 6) |
| Example 3 | YMCK mixture | 80% of whole toner image area | Supplied only on color toner (FIG. 8) |
| Example 4 | YMCK mixture | 80% of whole toner image area | Supplied only on color toner (FIG. 9) |
| Example 5 | YMCK mixture | Whole surface of patch image area | No supply of transparent toner (FIG. 7) |
| Example 6 | YMCK mixture | 80% of whole toner image area | Supplied only on color toner at end portion of cut portion (FIG. 12A) |
| Example 7 | YMCK mixture | 80% of whole toner image area | Supplied to vicinity of color toner at end portion of cut portion (FIGS. 10 and 11) |
| Example 8 | YMCK mixture | 80% of whole toner image area | Supplied to end portion of circular cut portion, with reduced amount (FIG. 12B) |
| Example 9 | YMCK mixture | 80% of whole toner image area | Supplied to end portion of square cut portion, with reduced amount (FIG. 13B) |

Note that, "Whole surface of toner image area" in "Color toner formation condition" represents that the color toner is supplied, for example, to the first portion P1 of FIG. 5, that is, all over the toner image area, and "80% of whole toner image area" represents that the color toner is supplied to 80% of the first portion P1 of FIG. 5, and the remaining 20% is a colorless area. Furthermore, in "Transparent toner formation condition", the corresponding form of a drawing for each example is given in parentheses.

TABLE 2

| | Transparent toner supply condition: Supply | Transparent toner supply condition: Reduction |
|---|---|---|
| Comparative Example | — | — |
| Example 1 | Color toner + transparent toner = constant | — |
| Example 2 | Color toner + transparent toner = constant | — |
| Example 3 | Color toner + transparent toner = constant | — |
| Example 4 | Constant in transparent toner | — |
| Example 5 | — | — |
| Example 6 | Constant in transparent toner | — |
| Example 7 | Constant in transparent toner | — |
| Example 8 | Constant in transparent toner | 80% |
| Example 9 | Constant in transparent toner | 80% |

Note that, "Color toner+transparent toner=constant" in "Supply" represents that a total thickness of those of the color and transparent toner is uniform at positions to which the transparent toner is supplied. Furthermore, "Constant in transparent toner" represents that the amount of the transparent toner is constant at positions to which the transparent toner is supplied. Still further, 80% in "Reduction" represents that the amount of the transparent toner to be supplied is 80% of that of the transparent toner fully supplied to the end portion of the portion to be cut out.

Evaluation results are given in Table 3.

TABLE 3

| | Evaluation results |
|---|---|
| Comparative Example | x |
| Example 1 | ○ |
| Example 2 | ○ |
| Example 3 | ○ |
| Example 4 | ○ |
| Example 5 | — |
| Example 6 | ○ |
| Example 7 | ○ |
| Example 8 | ○ |
| Example 9 | ○ |

Note that, "○" in the evaluation results represents that separation of the lamination was not generated, and "x" represents that separation of the lamination was generated.

From the above results, it was confirmed that separation of the lamination was generated in the comparative example, but the separation of the lamination was not generated in examples excluding Example 5 in which the transparent toner is not supplied on the patch image.

Although the present invention has been described and illustrated in detail, it is clearly understood that the same is by way of illustrated and example only and is not to be taken by way of limitation, the scope of the present invention being interpreted by terms of the appended claims.

What is claimed is:

1. An image forming apparatus comprising:

a color toner supply unit configured to supply, to a recording medium, color toner for forming a toner image on the recording medium;

a transparent toner supply unit configured to supply, to the recording medium, transparent toner having no releasability from a surface member bonded to a surface of the recording medium on which the toner image is formed; and a control unit configured to control the transparent toner supply unit to supply the transparent toner to cover the color toner supplied from the color toner supply unit to the recording medium; and a bonding device configured to bond the surface member to the recording medium on which the toner image is formed.

2. The image forming apparatus according to claim 1, wherein the control unit controls the transparent toner supply unit to supply the transparent toner only to a portion to which the color toner is supplied.

3. The image forming apparatus according to claim 1, wherein the control unit controls an amount of the transparent toner to be supplied to have a uniform thickness of the color toner and the transparent toner at positions in an area of the toner image to which the transparent toner is supplied.

4. The image forming apparatus according to claim 1, wherein the control unit controls the transparent toner supply unit to have the same thickness of the transparent toner at positions in an area of the toner image to which the transparent toner is supplied.

5. The image forming apparatus according to claim 1, further comprising an image carrier to which the color toner and the transparent toner are supplied from the color toner supply unit and the transparent toner supply unit, wherein the control unit controls the color toner supply unit to form a patch image on the image carrier, and controls the transparent toner supply unit not to supply the transparent toner to the image carrier upon forming the patch image on the image carrier.

6. The image forming apparatus according to claim 1, wherein an area of the toner image is formed in a portion to be cut out on the recording medium, and the control unit controls the transparent toner supply unit to supply the transparent toner only to an end portion of the portion to be cut out.

7. The image forming apparatus according to claim 6, wherein a portion to which the transparent toner is supplied, at the end portion of the portion to be cut out of the recording medium is a portion within a predetermined range on the inside of an edge of the portion to be cut out of the recording medium.

8. The image forming apparatus according to claim 6, wherein a portion to which the transparent toner is supplied, at the end portion of the portion to be cut out of the recording medium is a portion within a predetermined range on the outside of an edge of the portion to be cut out of the recording medium.

9. The image forming apparatus according to claim 6, wherein the transparent toner supplied to the end portion of the portion to be cut out of the recording medium is supplied after being reduced in amount at a predetermined rate.

10. The image forming apparatus according to claim 1, further comprising a cutting device configured to cut out the recording medium on which the surface member is bonded by the bonding device, into a predetermined size.

* * * * *